US008077097B2

(12) United States Patent
Chung et al.

(10) Patent No.: US 8,077,097 B2
(45) Date of Patent: Dec. 13, 2011

(54) DUAL-BAND ANTENNA AND ELECTRONIC DEVICE EMPLOYING THE SAME

(75) Inventors: Cho-Ju Chung, Taipei Hsien (TW); Teng-Huei Chu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 430 days.

(21) Appl. No.: 12/471,392

(22) Filed: May 24, 2009

(65) Prior Publication Data

US 2010/0265142 A1 Oct. 21, 2010

(30) Foreign Application Priority Data

Apr. 16, 2009 (CN) ..... 2009 2 0302267 U

(51) Int. Cl.
*H01Q 1/24* (2006.01)

(52) U.S. Cl. ..... 343/702

(58) Field of Classification Search ..... 343/702, 343/700 MS, 866, 748, 895
See application file for complete search history.

(56) References Cited

U.S. PATENT DOCUMENTS 6,362,789 B1 * 3/2002 Trumbull et al. ..... 343/700 MS
6,480,158 B2 * 11/2002 Apostolos ..... 343/700 MS
6,680,705 B2 * 1/2004 Tan et al. ..... 343/702
6,686,893 B2 * 2/2004 Lin et al. ..... 343/828
6,734,825 B1 * 5/2004 Guo et al. ..... 343/700 MS
7,136,025 B2 11/2006 Lin et al.
7,183,982 B2 * 2/2007 Kadambi et al. ..... 343/702
7,728,785 B2 * 6/2010 Ozden ..... 343/866
7,821,467 B2 * 10/2010 Sugiyama ..... 343/745

* cited by examiner

*Primary Examiner* — Huedung Mancuso
(74) *Attorney, Agent, or Firm* — Altis Law Group, Inc.

(57) ABSTRACT

A dual-band antenna includes a feed portion, a ground portion, a radiating portion and a fine-tuning portion. The feed portion is operable to feed electromagnetic signals. The radiating portion includes a first radiator, a second radiator and a connecting portion. The first radiator is elongated and has a first end electrically connected to the ground portion, and a second end of the first radiator is floating. The second radiator is U shaped, with two open ends floating. The connecting portion is connected to the first radiator, the second radiator and the feed portion. The feed portion feeds electromagnetic signal to the first radiator and the second radiator via the connecting portion. The fine-tuning portion is arranged around the second radiator, operable to control operating frequency bands of the second radiator.

14 Claims, 6 Drawing Sheets

DUAL-BAND ANTENNA AND ELECTRONIC DEVICE EMPLOYING THE SAME

BACKGROUND

1. Technical Field

Embodiments of the present disclosure relate to antennas, and more particularly to a dual-band antenna.

2. Description of Related Art

Antennas are necessary components in wireless communication devices, such as those utilizing BLUETOOTH and wireless local area network (WLAN) protocols. In production, such antennas inevitably exhibit deviations in shape or material. These deviations can lead to the antennas functioning in different operating bands than those expected.

BRIEF DESCRIPTION OF THE DRAWINGS

Many aspects of the disclosure can be better understood with reference to the following drawings.

DETAILED DESCRIPTION

Figure 1:
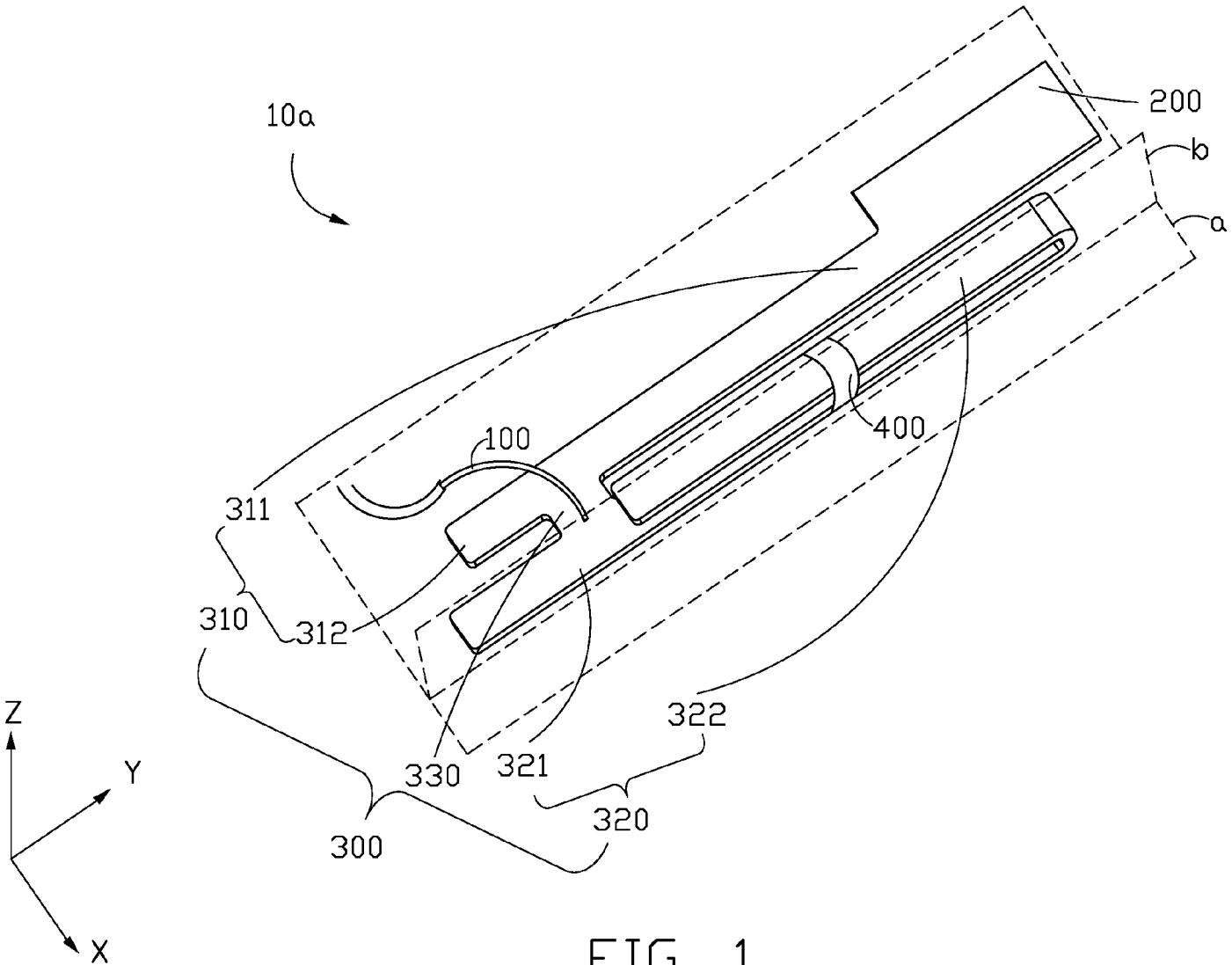
FIG. 1 is a schematic diagram of a dual-band antenna according to the present disclosure.
Figure 2:
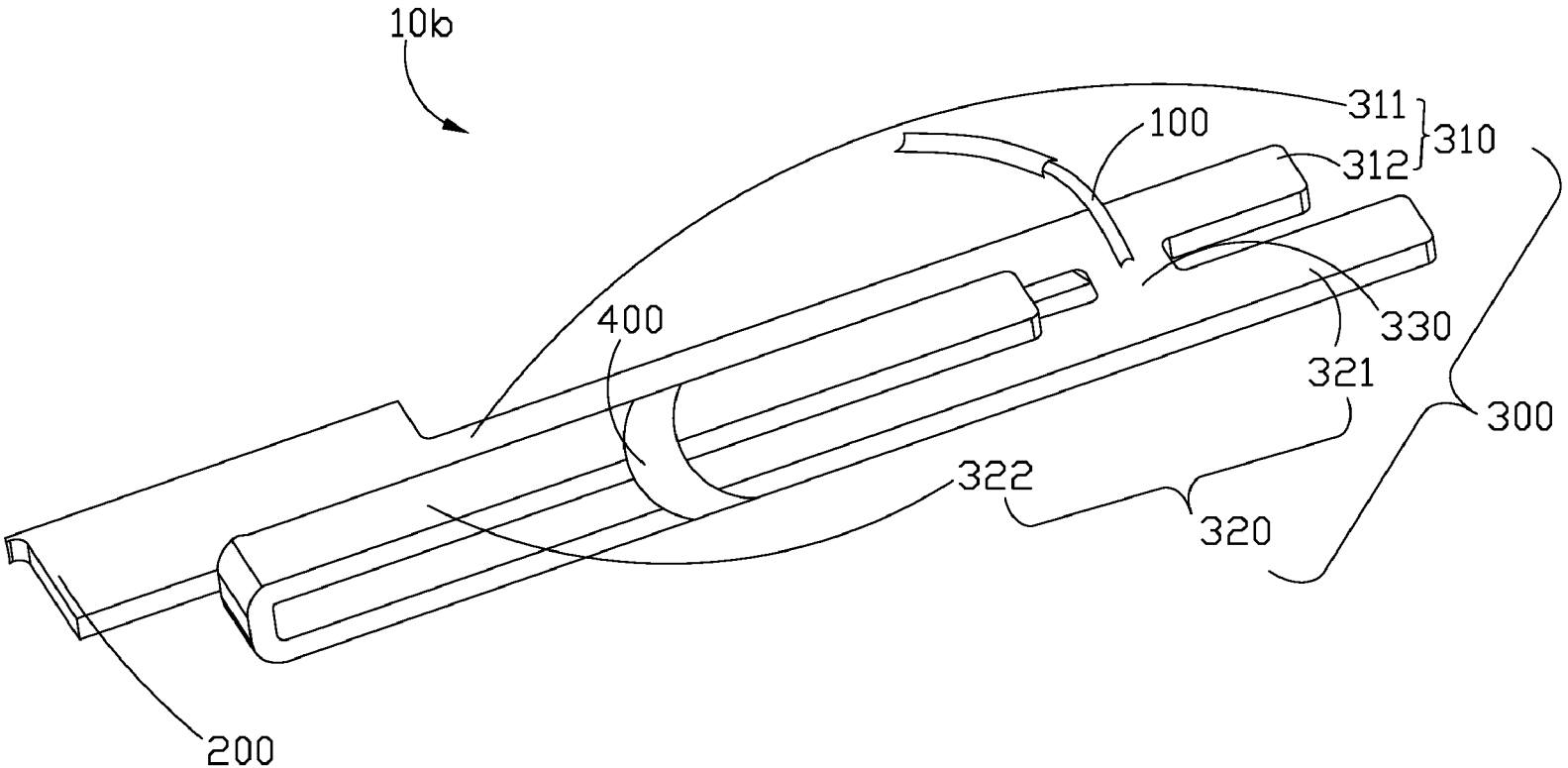
FIG. 2 is a schematic diagram of another embodiment of a dual-band antenna according to the present disclosure.

Referring to FIG. 1 and FIG. 2, two embodiments of a dual-band antenna 10*a* and 10*b* are disclosed. The dual-band antenna 10*a* and the dual-band antenna 10*b* comprise the same components, and are centro-symmetric. The dual-band antenna 10*a* comprises a feed portion 100, a ground portion 200, a radiating portion 300, and a fine-tuning portion 400.

The feed portion 100 is operable to feed electromagnetic signals. In one embodiment, the feed portion 100 may be a coaxial cable.

The ground portion 200 is substantially rectangular.

The radiating portion 300 is electrically connected to the ground portion 200, and operable to radiate electromagnetic signals. The radiating portion 300 is curved, so as to reduce the footprint of the dual-band antenna 10. The radiating portion 300 comprises a first radiator 310, a second radiator 320, and a connecting portion 330.

The first radiator 310 is elongated. A first end 311 of the first radiator 310 is electrically connected to the ground portion 200, and a second end of 312 of the first radiator 310 is floating. In one embodiment, the first radiator 310 is narrower than the ground portion 200.

The second radiator 320 is asymmetrically U shaped, and comprises two arms 321 with ends floating and a closed end 322. An extension of the second radiator 320 is elongated, and parallel with the first radiator 310.

The fine-tuning portion 400 is annular, and arranged around the second radiator 320. The fine-tuning portion 400 is operable to control the operating frequency bands of the second radiator 320. In one embodiment, the fine-tuning portion 400 is an insulating ring, such as a plastic ring.

The fine-tuning portion 400 is arranged from the closed end 322 of the second radiator 320 to the two open ends 321. Due to a dielectric constant of the fine-tuning portion 400 differing from that of air, a voltage standing wave ratio (VSWR) of the second radiator 320 can be controlled by the fine-tuning portion 400, so as to bring the actual VSWR to within an expected range. Thus, the fine-tuning portion can control the second radiator 320 to operate in a pre-determined one or more frequency bands.

The fine-tuning portion 400 is fixed on the second radiator 320 after controlling the second radiator 320 to operate in the frequency bands. In addition, the fine-tuning portion 400 is further operable to support the second radiator 320.

The connecting portion 330 is rectangular and connected to the first radiator 310, the second radiator 320, and the feed portion 100. The feed portion 100 is electrically connected to the substantial middle of the connecting portion 330, and feeds the electromagnetic signals to the first radiator 310 and the second radiator 320 via the connecting portion 330. In one embodiment, the connecting portion 330 is connected to the substantial middle of the first radiator 310 and the second radiator 320, respectively. In another embodiment, the shape and the length of the connecting portion 330 can be altered to match the impedances of the first radiator 310 and the second radiator 320.

The first radiator 310, the second radiator 320, and the feed portion 100 collectively form a straight F antenna, operating here in the frequency bands of approximately 2.4 GHz and 5 GHz, respectively, in one example.

In one embodiment, the ground portion 200, the first radiator 310, one arm of the second radiator 320, and the connecting portion 330 are in a first plane a. The second radiator 320 is in a second plane b. The second plane b is substantially perpendicular with the first plane a.

A projection of the second radiator 320 onto the first plane a is elongated. The length of the projection of the second radiator 320 is greater than the length of the first radiator 310. Projections of the first radiator 310, the second radiator 320, and the connecting portion 330 on the first plane a collectively form a substantial H shape figure.

Figure 3:
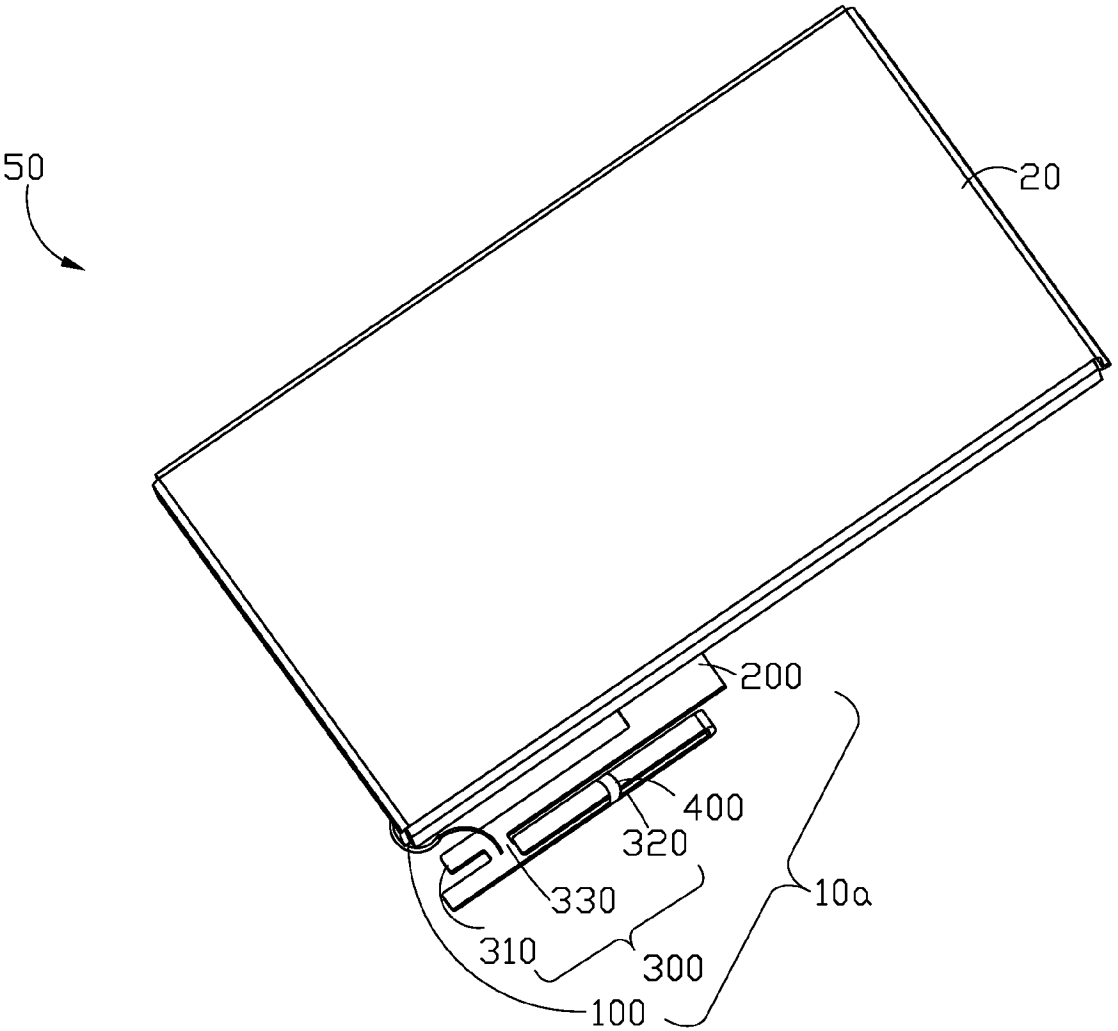
FIG. 3 is a schematic diagram of an electronic device employing a dual-band antenna such as, for example, that of FIG. 1 according to the present disclosure.

FIG. 3 is a schematic diagram of a first embodiment of an electronic device 50. The electronic device 50 comprises the dual-band antenna 10*a* of FIG. 1 and a shielding portion 20. The shielding portion 20 is a metal box of the electronic device 50. The dual-band antenna 10*a* and the shielding portion 20 are made in the same material, and collectively form an integral piece, so as to save time and cost to an assembly process of the electronic device 50. In another embodiment, the shielding portion 20 may have two dual-band antennas 10*a* and 10*b* as shown in FIG. 1 and FIG. 2 on opposite sides.

In the illustrated embodiment, the ground portion 200 is electrically connected to a side of the shielding portion 20. The dual-band antenna 10*a* is connected to the shielding portion 20 by the ground portion 200. The first radiator 310 and the second radiator 320 of the dual-band antenna 10*a* are substantially parallel with the side of the shielding 200 connected to the ground portion 200.

Figure 4:
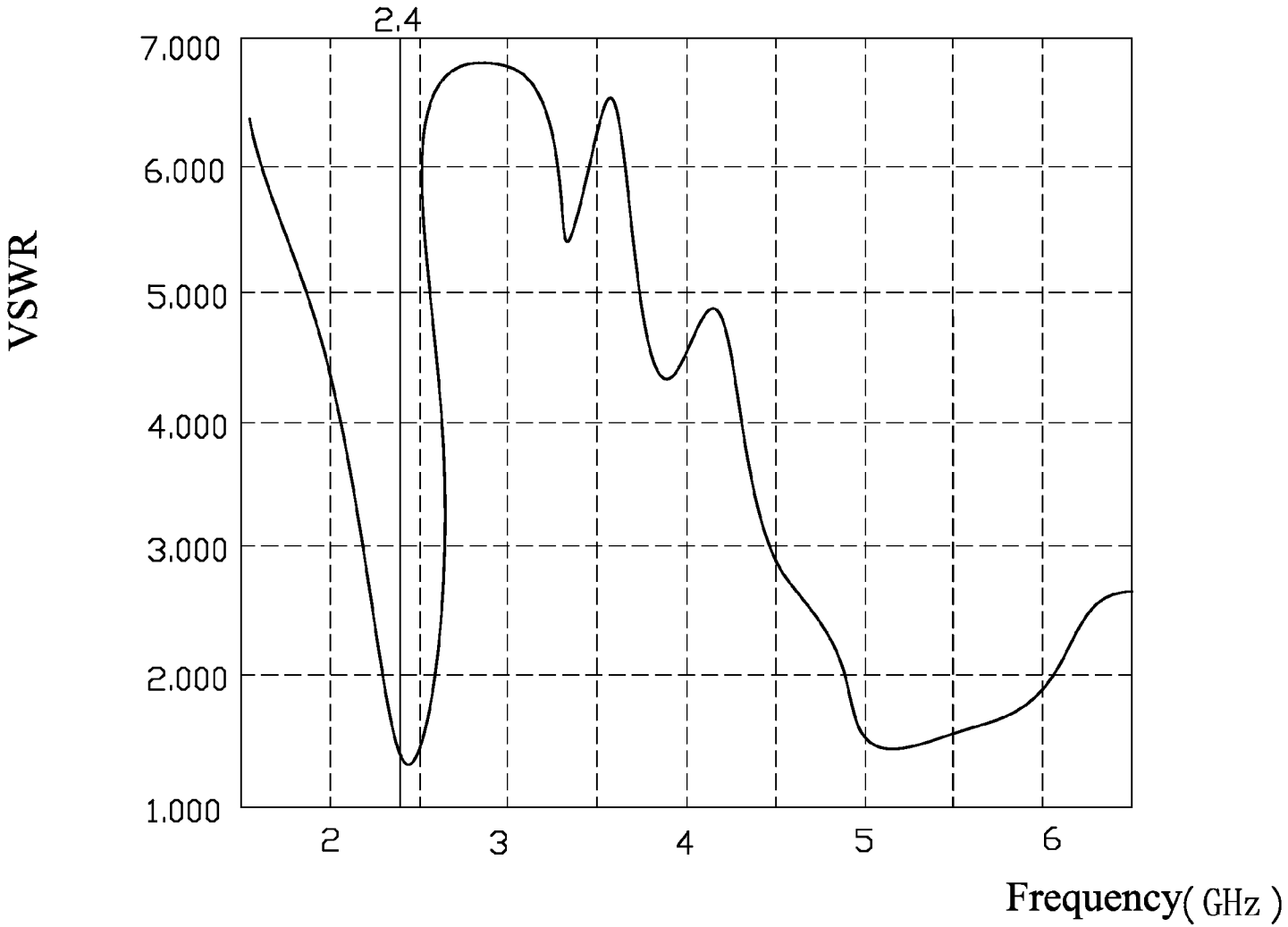
FIG. 4 is a graph of a voltage standing wave ratio (VSWR) of the dual-band antenna of FIG. 1.

FIG. 4 is a graph showing a voltage standing wave ratio (VSWR) of the dual-band antenna 10*a* of FIG. 1. As shown, when the dual-band antenna 10*a* operates in the frequency bands from 2.4 GHz to 2.5 GHz and from 5.15 GHz to 5.85 GHz, the VSWRs of the dual-band antenna 10*a* are less than 2, therefore the return loss of the dual-band antenna 10*a* will less than −10 dB, complying with the industry standard on return loss. In addition, the operating frequency bands of the dual-band antenna 10*a* cover a wide range of applications, such as the IEEE 802.11a/b/g standard.

Figure 5:
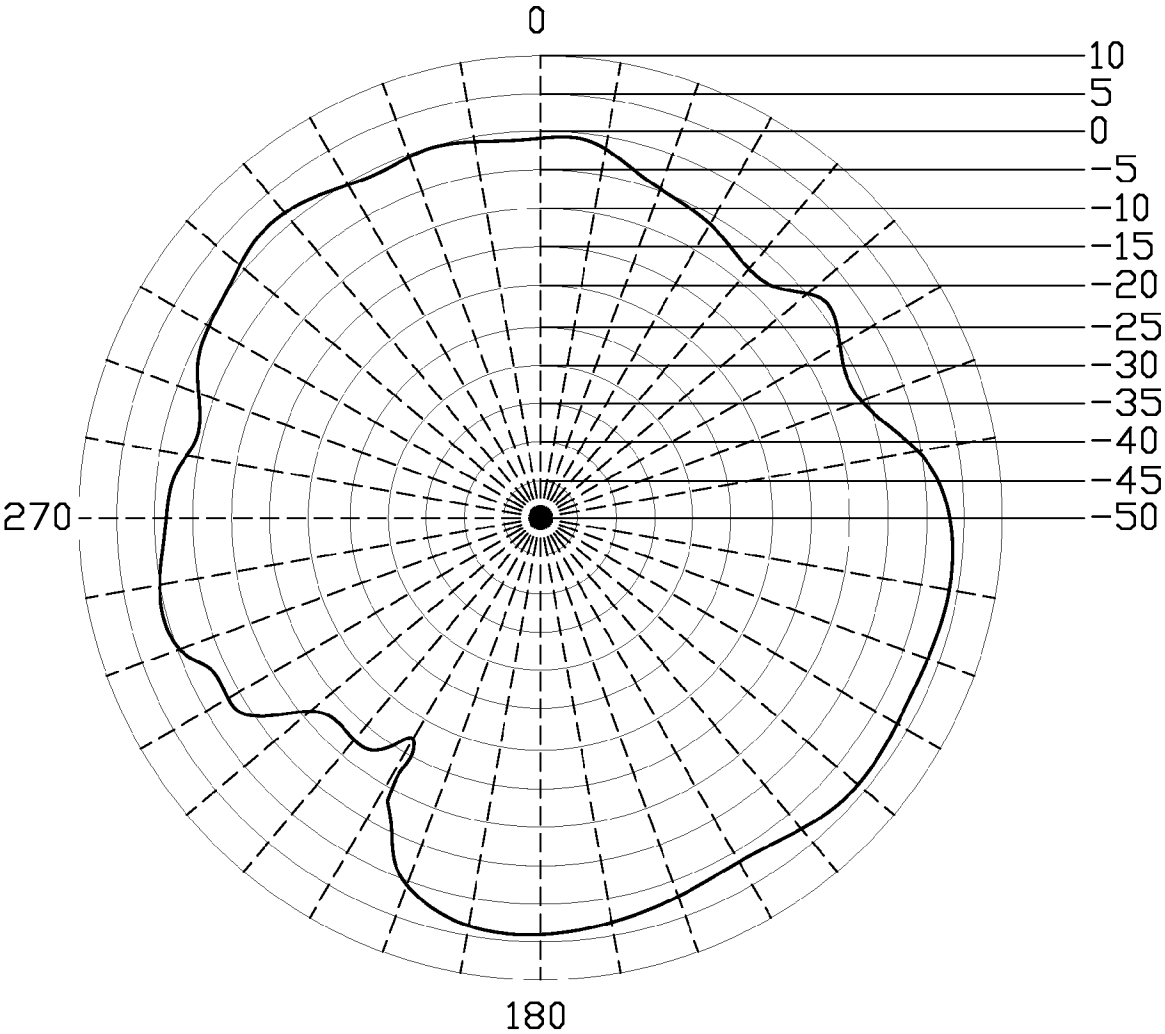
FIG. 5 is a test chart showing an exemplary radiation pattern on an X-Y plane when the dual-band antenna of FIG. 1 operates at a frequency band of approximately 2.4 gigahertz (GHz)
Figure 6:
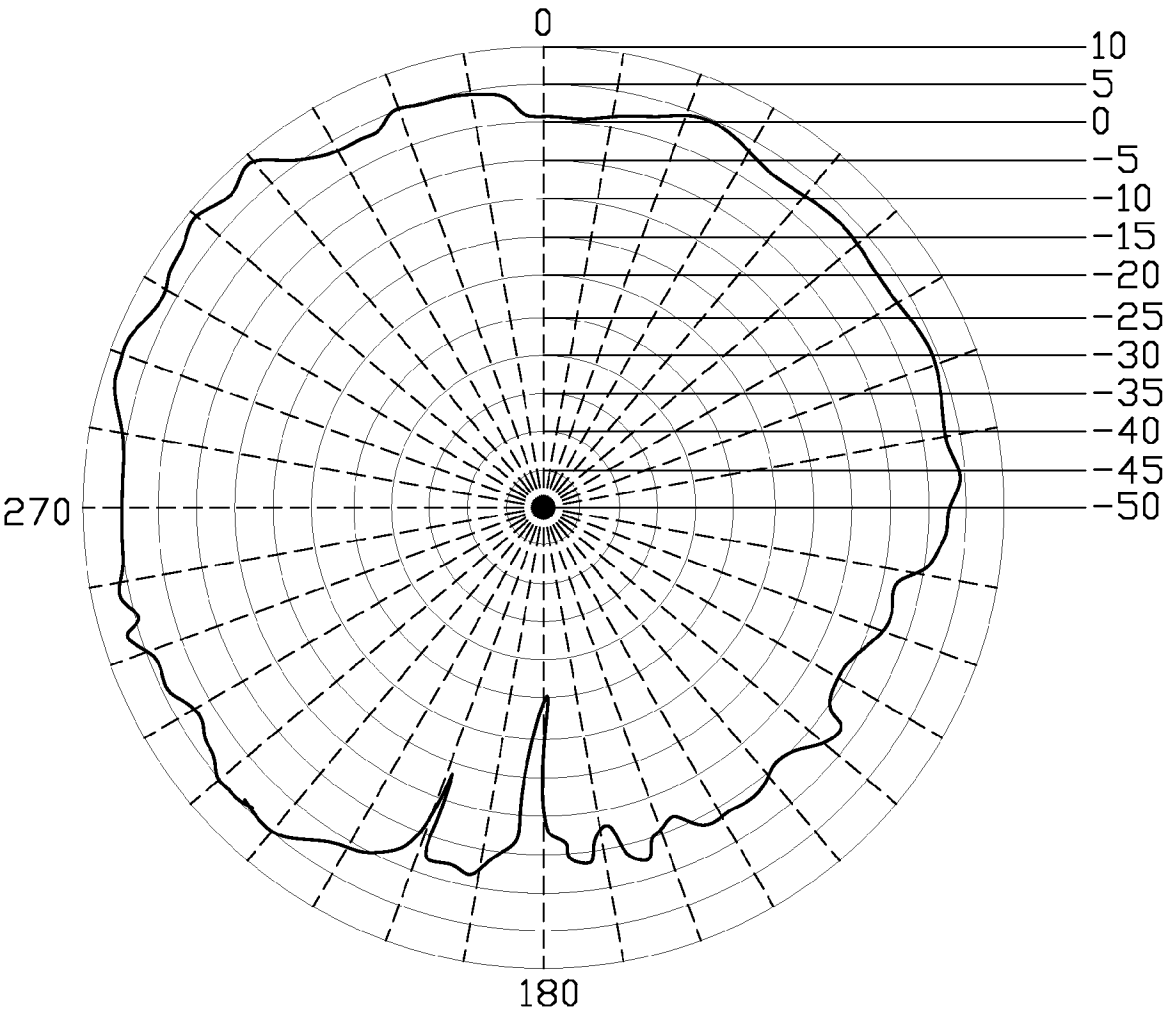
FIG. 6 is a test chart showing an exemplary radiation pattern on an X-Y plane when the dual-band antenna of FIG. 1 operates at a frequency band of approximately 5 GHz.

FIGS. 5-6 are test charts showing exemplary radiation patterns on an X-Y plane when the dual-band antenna 10*a* operates at frequency bands of approximately 2.4 GHz and 5 GHz, respectively. As shown, the dual-band antenna 10*a* has no obvious blind zone.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A dual-band antenna, comprising:

a feed portion operable to feed electromagnetic signals;

a ground portion;

a radiating portion, comprising:

a first radiator being elongated, wherein a first end of the first radiator is electrically connected to the ground portion, and a second end of the first radiator is floating;

a second radiator with two arms forming a U shape, wherein ends of the second radiator are floating; and a connecting portion connected to the first radiator, the second radiator, and the feed portion, wherein the feed portion feeds electromagnetic signals to the first radiator and the second radiator via the connecting portion; and a fine-tuning portion arranged around the second radiator, operable to control operating frequency bands of the second radiator;

wherein the ground portion, the first radiator, and the connecting portion are on a first plane, the second radiator is formed by bending a rectangular-shaped portion into a second plane, and the second plane is substantially perpendicular to the first plane.

2. The dual-band antenna as claimed in claim 1, wherein the fine-tuning portion is an insulation ring.

3. The dual-band antenna as claimed in claim 1, wherein the feed portion is a coaxial cable.

4. The dual-band antenna as claimed in claim 3, wherein the feed portion is electrically connected to the substantial center of the connecting portion.

5. The dual-band antenna as claimed in claim 1, wherein a projection of the second radiator on the first plane is elongated.

6. The dual-band antenna as claimed in claim 5, wherein projections of the first radiator, the second radiator, and the connecting portion on the first plane collectively form a substantially H shape figure.

7. An electronic device, operable to radiate electromagnetic signals, comprising:

a shielding portion;

a ground portion that is substantially rectangular, electrically connected to the shielding portion;

a feed portion operable to feed electromagnetic signals;

a radiating portion, comprising:

an elongated first radiator, a first end of which is electrically connected to the ground portion, and a second end of which is floating;

a second radiator with two floating arms forming a U shape; and a connecting portion connected to the first radiator, the second radiator and the feed portion, wherein the feed portion feeds electromagnetic signal to the first radiator and the second radiator via the connecting portion; and a fine-tuning portion arranged around the second radiator, operable to control operating frequency bands of the second radiator;

wherein the ground portion, the first radiator, one arm of the second radiator and the connecting portion are in a first plane, two arms of the second radiator are arranged on a second plane, and the second plane is perpendicular to the first plane.

8. The electronic device as claimed in claim 7, wherein the shielding portion is a metal box of the electronic device.

9. The electronic device as claimed in claim 8, wherein the ground portion and the shielding collectively form an integral piece.

10. The electronic device as claimed in claim 8, wherein the fine-tuning portion is an insulation ring.

11. The electronic device as claimed in claim 7, wherein the feed portion is a coaxial cable.

12. The electronic device as claimed in claim 11, wherein the feed portion is electrically connected to the substantial middle of the connecting portion.

13. The electronic device as claimed in claim 7, wherein a projection of the second radiator on the first plane is elongated.

14. The electronic device as claimed in claim 13, wherein projections of the first radiator, the second radiator, and the connecting portion on the first plane collectively form a substantial H shape figure.

* * * * *